US006325564B1

(12) United States Patent
Knowles

(10) Patent No.: US 6,325,564 B1
(45) Date of Patent: Dec. 4, 2001

(54) LONG HANDLE LOTION APPLICATOR

(76) Inventor: Patrick Knowles, 2204 Cary Rd, Algonquin, IL (US) 60102

( * ) Notice: Subject to any disclaimer, the term of this patent is extended or adjusted under 35 U.S.C. 154(b) by 0 days.

(21) Appl. No.: 09/844,594

(22) Filed: Apr. 27, 2001

(51) Int. Cl.[7] ..... B43K 5/06

(52) U.S. Cl. ..... 401/179; 401/176; 401/171; 401/261; 401/286; 401/289

(58) Field of Search ..... 401/140, 139, 401/138, 137, 150, 146, 182, 180, 179, 178, 177, 176, 171, 266, 265, 263, 261, 289, 286, 283, 282, 279, 278, 275, 271, 268

(56) References Cited

U.S. PATENT DOCUMENTS

| | | | | |
|---|---|---|---|---|
| 2,043,145 | * | 6/1936 | Bacher | 401/263 |
| 2,438,843 | * | 3/1948 | Correa | 222/391 |
| 4,944,623 | * | 7/1990 | McNeil | 401/25 |
| 5,116,151 | * | 5/1992 | Lytton et al. | 401/9 |
| 5,141,348 | * | 8/1992 | 'Tartt | 401/140 |
| 5,890,829 | * | 4/1999 | Hesse | 401/179 |
| 6,190,073 | * | 2/2001 | Kabigting | 401/6 |

* cited by examiner

*Primary Examiner*—Gregory L. Huson
*Assistant Examiner*—Huyen Le
(74) *Attorney, Agent, or Firm*—Goldstein Law Offices, P.C.

(57) ABSTRACT

A long handle lotion applicator including an elongated handle portion having a closed outer end and an open inner end. A lotion housing is coupled with respect to the elongated handle portion. The lotion housing has an open inner end removably coupled with the open inner end of the handle portion. The lotion housing contains a quantity of lotion therein. The closed outer end of the lotion housing has an aperture therethrough. A tap portion is secured to the closed outer end of the lotion housing. The tap portion has a central tube having an open inner end and an open outer end. The open inner end is coupled with the aperture in the closed outer end of the lotion housing. A sponge portion is removably coupled with the tap portion and in communication with the open outer end of the central tube. A pump portion is disposed within the handle portion and the lotion housing for directing the lotion outwardly of the aperture in the closed outer end of the lotion housing and into the central tube of the tap portion and into the sponge portion for application on a user.

6 Claims, 2 Drawing Sheets

LONG HANDLE LOTION APPLICATOR

BACKGROUND OF THE INVENTION

The present invention relates to a long handle lotion applicator and more particularly pertains to allowing lotion to be applied on a person's back.

The use of dispenser devices is known in the prior art. More specifically, dispenser devices heretofore devised and utilized for the purpose of dispensing a variety of liquids are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,372,700 to Moffit, Jr. discloses a brush with a reservoir and dispenser using a piston pump. U.S. Pat. Nos. 5,240,339 to Deforest and 5,961,235 to Kennedy disclose elongated applicators for dispensing lotion to hard to reach places.

While these devices fulfill their respective, particular objective and requirements, the aforementioned patents do not describe a long handle lotion applicator for allowing lotion to be applied on a person's back.

In this respect, the long handle lotion applicator according to the present invention substantially departs from the conventional concepts and designs of the prior art, and in doing so provides an apparatus primarily developed for the purpose of allowing lotion to be applied on a person's back.

Therefore, it can be appreciated that there exists a continuing need for a new and improved long handle lotion applicator which can be used for allowing lotion to be applied on a person's back. In this regard, the present invention substantially fulfills this need.

SUMMARY OF THE INVENTION

In the view of the foregoing disadvantages inherent in the known types of dispenser devices now present in the prior art, the present invention provides an improved long handle lotion applicator. As such, the general purpose of the present invention, which will be described subsequently in greater detail, is to provide a new and improved long handle lotion applicator which has all the advantages of the prior art and none of the disadvantages.

To attain this, the present invention essentially comprises an elongated handle portion having a closed outer end and an open inner end. The open inner end has a washer disposed therein. The handle portion has a slot formed therein inwardly of the closed outer end. A lotion housing is coupled with respect to the elongated handle portion. The lotion housing has an open inner end and a closed outer end. The open inner end removably couples with the open inner end of the handle portion. The lotion housing contains a quantity of lotion therein. The closed outer end of the lotion housing has an aperture therethrough. A tap portion is secured to the closed outer end of the lotion housing. The tap portion is angularly oriented. The tap portion has a central tube having an open inner end and an open outer end. The open inner end is coupled with the aperture in the closed outer end of the lotion housing. The tap portion has a lower tack portion with the open outer end of the central tube extending outwardly thereof. A sponge portion is removably coupled with the lower tack portion of the tap portion in communication with the open outer end of the central tube. A pump portion is disposed within the handle portion and the lotion housing for directing the lotion outwardly of the aperture in the closed outer end of the lotion housing and into the central tube of the tap portion and into the sponge portion for application on a user. The pump portion includes an elongated shaft slidably disposed within the handle portion and the lotion housing. The shaft has an inner end and an outer end. The inner end has a slide handle secured thereto and extending outwardly of the slot in the handle portion. The outer end of the shaft has a push plate secured thereto. The shaft has a spring disposed thereon for biasing the shaft toward the outer end of the handle portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved long handle lotion applicator which has all the advantages of the prior art dispenser devices and none of the disadvantages.

It is another object of the present invention to provide a new and improved long handle lotion applicator which may be easily and efficiently manufactured and marketed.

It is a further object of the present invention to provide a new and improved long handle lotion applicator which is of durable and reliable construction.

An even further object of the present invention is to provide a new and improved long handle lotion applicator which is susceptible of a low cost of manufacture with regard to both materials and labor, and which accordingly is then susceptible of low prices of sale to the consuming public, thereby making such a long handle lotion applicator economically available to the buying public.

Even still another object of the present invention is to provide a new and improved long handle lotion applicator for allowing lotion to be applied on a person's back.

Lastly, it is an object of the present invention to provide a new and improved long handle lotion applicator including an elongated handle portion having a closed outer end and an open inner end. A lotion housing is coupled with respect to the elongated handle portion. The lotion housing has an open inner end and a closed outer end. The open inner end removably couples with the open inner end of the handle portion. The lotion housing contains a quantity of lotion therein. The closed outer end of the lotion housing has an aperture therethrough. A tap portion is secured to the closed outer end of the lotion housing. The tap portion has a central tube having an open inner end and an open outer end. The open inner end is coupled with the aperture in the closed outer end of the lotion housing. The tap portion has a lower tack portion with the open outer end of the central tube extending outwardly thereof. A sponge portion is removably coupled with the lower tack portion of the tap portion in communication with the open outer end of the central tube. A pump portion is disposed within the handle portion and the lotion housing for directing the lotion outwardly of the aperture in the closed outer end of the lotion housing and into the central tube of the tap portion and into the sponge portion for application on a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
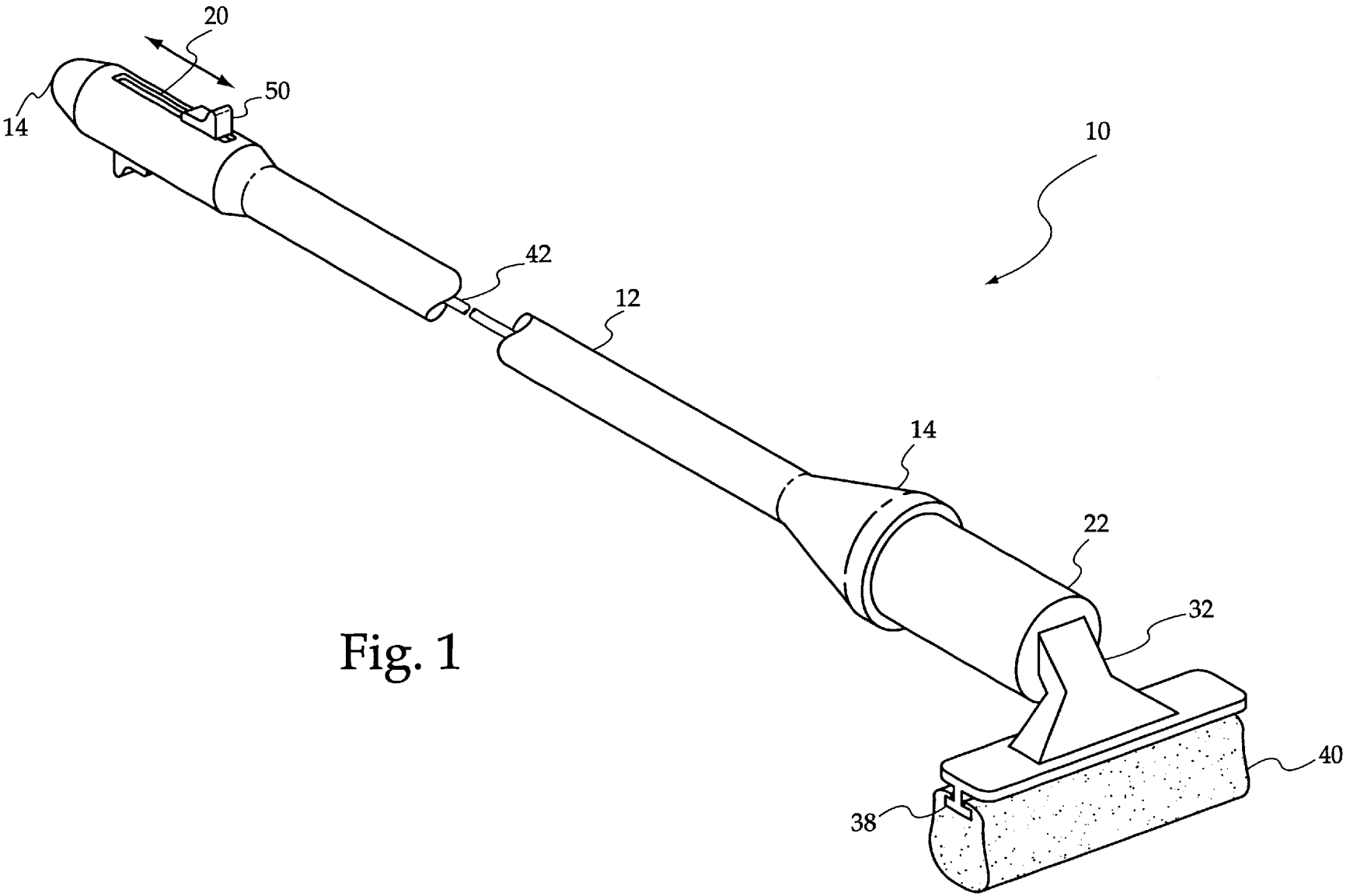
FIG. 1 is a perspective view of the preferred embodiment of the long handle lotion applicator constructed in accordance with the principles of the present invention.
Figure 2:
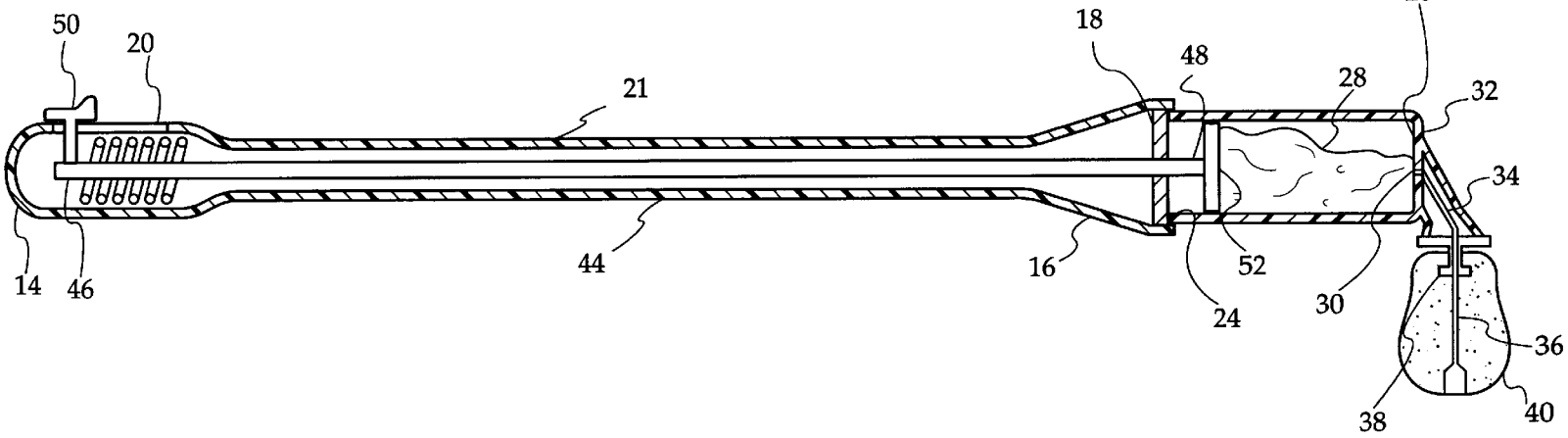
FIG. 2 is a cross-sectional side view of the present invention.
Figure 3:
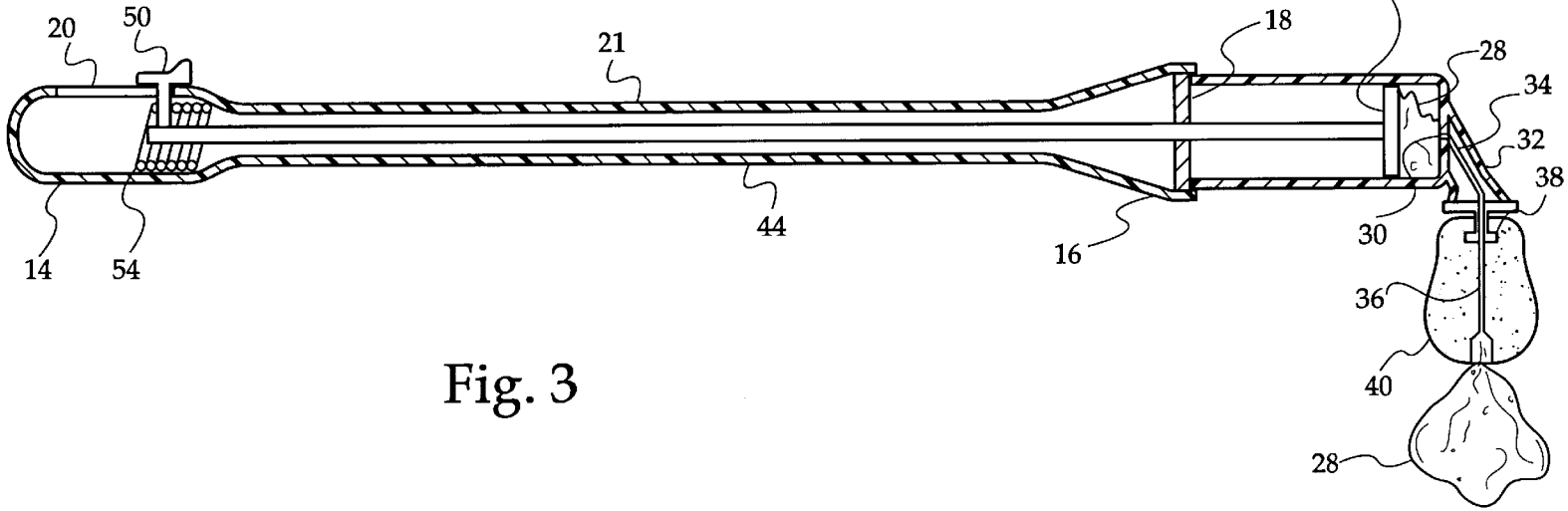
FIG. 3 is a cross-sectional side view of the present invention illustrated in use.

With reference now to the drawings, and in particular, to FIGS. 1 through three thereof, the preferred embodiment of the new and improved long handle lotion applicator embodying the principles and concepts of the present invention and generally designated by the reference number 10 will be described.

Specifically, it will be noted in the various Figures that the device relates to a long handle lotion applicator for allowing lotion to be applied on a person's back. In its broadest context, the device consists of an elongated handle portion, a lotion housing, a tap portion, a sponge portion, and a pump portion. Such components are individually configured and correlated with respect to each other so as to attain the desired objective.

The elongated handle portion 12 has a closed outer end 14 and an open inner end 16. The open inner end 16 has a washer 18 disposed therein. The handle portion 12 has a slot 20 formed therein inwardly of the closed outer end 14. In the preferred embodiment, the closed outer end 14 is essentially bulbous and the open inner end 16 is essentially frustoconical. An intermediate extent 21 between the outer and inner ends 14,16 is narrow in comparison.

The lotion housing 22 is coupled with respect to the elongated handle portion 12. The lotion housing 22 has an open inner end 24 and a closed outer end 26. The open inner end 24 removably couples with the open inner end 16 of the handle portion 12. The lotion housing 22 contains a quantity of lotion 28 therein. The closed outer end 26 of the lotion housing 22 has an aperture 30 therethrough. The lotion housing 22 is preferably coupled with the handle portion 12 through the use of internal and external threads to allow for easy removal and replacement once the housing 22 is empty of lotion 28.

The tap portion 32 is secured to the closed outer end 26 of the lotion housing 22. The tap portion 32 is angularly oriented. The tap portion 32 has a central tube 34 having an open inner end and an open outer end 36. The open inner end is coupled with the aperture 30 in the closed outer end 26 of the lotion housing 22. The tap portion 32 has a lower tack portion 38 with the open outer end 36 of the central tube 34 extending outwardly thereof. The central tube 34 will allow the lotion 28 to be dispensed from the lotion housing 22.

The sponge portion 40 is removably coupled with the lower tack portion 38 of the tap portion 32 in communication with the open outer end 36 of the central tube 34. The sponge portion 40 will receive the lotion 28 therein from the central tube 34 to be applied on the body of the individual.

The pump portion 42 is disposed within the handle portion 12 and the lotion housing 22 for directing the lotion 28 outwardly of the aperture 30 in the closed outer end 26 of the lotion housing 22 and into the central tube 34 of the tap portion 32 and into the sponge portion 40 for application on a user. The pump portion 42 includes an elongated shaft 44 slideably disposed within the handle portion 12 and the lotion housing 22. The shaft 44 has an inner end 46 and an outer end 48. The inner end 46 has a slide handle 50 secured thereto and extending outwardly of the slot 20 in the handle portion 12. The outer end 48 of the shaft 44 has a push plate 52 secured thereto. The shaft 44 has a spring 54 disposed thereon for biasing the shaft 44 toward the outer end 14 of the handle portion 12. The user will operate the pump portion 42 simply by sliding the slide handle 50 forward to move the shaft 44 and the push plate 52 forwardly to force the lotion 28 out of the liquid housing 22, through the tap portion 32 and into the sponge portion 40 for application.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A long handle lotion applicator for allowing lotion to be applied on a person's back comprising, in combination:

an elongated handle portion having a closed outer end and an open inner end, the open inner end having a washer disposed therein, the handle portion having a slot formed therein inwardly of the closed outer end;

a lotion housing coupled with respect to the elongated handle portion, the lotion housing having an open inner end and a closed outer end, the open inner end removably coupling with the open inner end of the handle portion, the lotion housing containing a quantity of lotion therein, the closed outer end of the lotion housing having an aperture therethrough;

a tap portion secured to the closed outer end of the lotion housing, the tap portion being angularly oriented, the tap portion having a central tube having an open inner end and an open outer end, the open inner end being coupled with the aperture in the closed outer end of the lotion housing, the tap portion having a lower tack portion with the open outer end of the central tube extending outwardly thereof;

a sponge portion removably coupled with the lower tack portion of the tap portion in communication with the open outer end of the central tube; and a pump portion disposed within the handle portion and the lotion housing for directing the lotion outwardly of the aperture in the closed outer end of the lotion housing and into the central tube of the tap portion and into the sponge portion for application on a user, the pump portion including an elongated shaft slidably disposed within the handle portion and the lotion housing, the shaft having an inner end and an outer end, the inner end having a slide handle secured thereto and extending outwardly of the slot in the handle portion, the outer end of the shaft having a push plate secured thereto, the shaft having a spring disposed thereon for biasing the shaft toward the outer end of the handle portion.

2. A long handle lotion applicator for allowing lotion to be applied on a person's back comprising, in combination:

an elongated handle portion having a closed outer end and an open inner end;

a lotion housing coupled with respect to the elongated handle portion, the lotion housing having an open inner end and a closed outer end, the open inner end removably coupling with the open inner end of the handle portion, the lotion housing containing a quantity of lotion therein, the closed outer end of the lotion housing having an aperture therethrough;

a tap portion secured to the closed outer end of the lotion housing, the tap portion having a central tube having an open inner end and an open outer end, the open inner end being coupled with the aperture in the closed outer end of the lotion housing, the tap portion having a lower tack portion with the open outer end of the central tube extending outwardly thereof;

a sponge portion removably coupled with the lower tack portion of the tap portion in communication with the open outer end of the central tube; and a pump portion disposed within the handle portion and the lotion housing for directing the lotion outwardly of the aperture in the closed outer end of the lotion housing and into the central tube of the tap portion and into the sponge portion for application on a user.

3. The long handle lotion applicator as set forth in claim two, wherein the tap portion is angularly oriented.

4. The long handle lotion applicator as set forth in claim two, wherein the pump portion includes an elongated shaft slidably disposed within the handle portion and the lotion housing, the shaft having an inner end and an outer end, the inner end having a slide handle secured thereto and extending outwardly of a slot in the handle portion.

5. The long handle lotion applicator as set forth in claim four, wherein the outer end of the shaft has a push plate secured thereto.

6. The long handle lotion applicator as set forth in claim five, wherein the shaft has a spring disposed thereon for biasing the shaft toward the outer end of the handle portion.

* * * * *